US010858777B2

(12) United States Patent
Bringewatt et al.

(10) Patent No.: US 10,858,777 B2
(45) Date of Patent: Dec. 8, 2020

(54) METHOD AND DEVICE FOR SUPPLYING LAUNDRY ITEMS TO A LAUNDRY TREATMENT DEVICE, IN PARTICULAR A MANGLE

(71) Applicant: Herbert Kannegiesser GmbH, Vlotho (DE)

(72) Inventors: Wilhelm Bringewatt, Porta Westfalica (DE); Thomas Klarhorst, Vlotho (DE); Arthur Malikowski, Detmold (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 105 days.

(21) Appl. No.: 16/316,931

(22) PCT Filed: Sep. 15, 2017

(86) PCT No.: PCT/EP2017/001095

§ 371 (c)(1),
(2) Date: Jan. 10, 2019

(87) PCT Pub. No.: WO2018/059730

PCT Pub. Date: Apr. 5, 2018

(65) Prior Publication Data

US 2019/0234005 A1 Aug. 1, 2019

(30) Foreign Application Priority Data

Sep. 29, 2016 (DE) ..... 10 2016 011 675

(51) Int. Cl.
*D06F 67/04* (2006.01)

(52) U.S. Cl.
CPC ..... *D06F 67/04* (2013.01)

(58) Field of Classification Search
CPC ..... D06F 67/04; B65G 49/00
See application file for complete search history.

(56) References Cited

U.S. PATENT DOCUMENTS 3,431,665 A 3/1969 Weir
3,838,481 A * 10/1974 Kuroda ..... D06C 3/062 26/77

(Continued)

FOREIGN PATENT DOCUMENTS

DE 1610297 B1 8/1971
DE 19504948 A1 8/1996

(Continued)

OTHER PUBLICATIONS

WIPO, International Search Report (on priority application), dated Feb. 2, 2018.

*Primary Examiner* — Ismael Izaguirre
(74) *Attorney, Agent, or Firm* — Laurence P. Colton; Smith Tempel Blaha LLC

(57) ABSTRACT

Laundry items by way of devices are fed to mangles, for example. The laundry items by way of the corners thereof are transferred to clamps, for example spreader clamps during the feeding procedure. Tails of the laundry item that project beyond the clamping locations of the spreader clamps are usually formed herein. Said tails lead to so-called ears in particular on the front periphery of the laundry item that is tautly stretched by the spreader clamps. Said ears compromise the quality of the laundry items, specifically of mangled laundry items. The invention provides for the tails in the spreader clamps to be eliminated in that the tails are transported through the spreader clamps so far until the corners of the laundry item are still held in the spreader clamps only at the outermost corner points. The tails are effectively eliminated in that ears can no longer be formed.

15 Claims, 16 Drawing Sheets

(56) References Cited

U.S. PATENT DOCUMENTS

| | | | | | |
|---|---|---|---|---|---|
| 3,911,604 | A | | 10/1975 | Sjostrom | |
| 4,979,868 | A | * | 12/1990 | Ueda | B61B 10/025 38/12 |
| 5,169,282 | A | * | 12/1992 | Ueda | D06F 67/04 38/7 |
| 5,515,627 | A | * | 5/1996 | McCabe | D06F 67/04 38/143 |
| 6,584,711 | B1 | * | 7/2003 | Nakamura | D06F 67/04 38/143 |
| 7,448,152 | B2 | * | 11/2008 | Jensen | D06F 67/04 38/143 |
| 9,222,213 | B2 | * | 12/2015 | Garrone | D06F 67/04 |
| 2004/0226198 | A1 | * | 11/2004 | Borucki | D06F 67/04 38/143 |
| 2009/0260950 | A1 | * | 10/2009 | Heinz | D06F 67/04 198/341.01 |

FOREIGN PATENT DOCUMENTS

| | | | |
|---|---|---|---|
| DE | 69516894 | T2 | 10/2000 |
| DE | 102008021810 | A1 | 4/2009 |
| JP | H1024200 | A | 1/1998 |
| WO | 2005038121 | A2 | 4/2005 |

* cited by examiner

METHOD AND DEVICE FOR SUPPLYING LAUNDRY ITEMS TO A LAUNDRY TREATMENT DEVICE, IN PARTICULAR A MANGLE

CROSS REFERENCE TO RELATED APPLICATIONS

This application is the US National Phase of and claims the benefit of and priority on International Application No. PCT/EP2017/001095 having a filing date of 15 Sep. 2017, which claims priority on and the benefit of German Patent Application No. 10 2016 011 675.7 having a filing date of 29 Sep. 2016.

BACKGROUND OF THE INVENTION

Technical Field

The invention relates to a method for feeding laundry items to a laundry treatment installation, in particular a mangle, wherein a transverse periphery is stretched by a spreading installation having spreader clamps for holding neighboring corner regions of the transverse periphery of the laundry item and the laundry item herein is spread out, and the spread-out laundry item by way of the stretched front transverse periphery is deposited onto an infeed conveyor or a depositing strip, and to a method for feeding laundry items to a laundry treatment installation, in particular a mangle, wherein a respective laundry item by way of a peripheral portion that lies between two neighboring corners of a transverse periphery is deposited on at least one loading station, is transported beyond an end of the loading station until two neighboring corner regions of an opposite transverse edge of the laundry item are configured at the end of the loading station and said corner regions of the laundry item are gripped.

The invention furthermore relates to a device for feeding laundry items to a laundry treatment installation, in particular a mangle, having an infeed conveyor for transporting spread-out laundry items in the feeding direction to the laundry treatment installation, optionally to a depositing strip that is assigned to the infeed conveyor, and a spreading installation for spreading out and subsequently depositing the laundry item on the infeed conveyor, or the depositing strip assigned to the latter, respectively, said spreading installation having spreader clamps that are repositionable transversely to the infeed direction and to a device for feeding laundry items to a laundry treatment installation, in particular a mangle, having a plurality of loading stations that are disposed beside one another in a row that runs transversely to the feeding direction of the laundry item to the laundry treatment installation, said laundry treatment installation having in each case one loading conveyor and, when viewed in the feeding direction, disposed downstream of said loading conveyor, corner locators for neighboring corner regions of a transverse periphery of a laundry item, and each corner locator being configured for transporting therethrough a lateral longitudinal peripheral region of the laundry item.

Prior Art

Laundry items are fed to laundry treatment installations such as, for example mangles, by way of devices usually referred to as input machines. Transverse peripheries of the laundry items, which hereunder are also referred to as the front periphery or the rear periphery, herein run transversely to the feeding direction. As opposed thereto, peripheries of the laundry items that hereunder are referred to as lateral peripheries or else longitudinal peripheries run in the feeding direction. The terms transverse peripheries, on the one hand, and lateral peripheries or longitudinal peripheries, respectively, on the other hand, in terms of the following description are not intended to have any influence on the orientation of the laundry items in the feeding direction. Consequently, transverse peripheries can be long peripheries or else short peripheries of the laundry items. The same applies to lateral peripheries or longitudinal peripheries, respectively.

It is known for the laundry items to be spread out by a spreading installation and to be deposited in a spread-out state suspended on the spreading installation onto an infeed conveyor or onto a depositing strip assigned to the latter. To this end, the spreading installation has spreader clamps which are repositionable transversely to the feeding direction and which hold neighboring corners or corner regions of a transverse periphery, in particular the front transverse periphery, and stretch or spread, respectively, said transverse periphery by diverging and herein spread out the laundry item suspended on the spreader clamps.

It is also known for the laundry items to be placed on a plurality of loading stations disposed beside one another by way of a portion of the transverse edge of said laundry items that lies between neighboring corners. The laundry items are then transported from each loading station in the feeding direction of the input machine, and opposite corners of the rear transverse edge of the respective laundry item are re-oriented herein and transferred by a transfer clamp pair to two spreader clamps of the spreading installation, or directly to spreader clamps.

In both known procedures it is disadvantageous that the spreader clamps hold neighboring corners of the front transverse edge of the respective laundry item to be spread so as to be spaced apart from the geometric corner point such that tails of the corners of the transverse edge project on the spreader clamps. This leads in the depositing of the tautly stretched transverse edge having the transverse edge region of the laundry item proceeding therefrom onto the infeed conveyor, or the depositing strip, respectively, to elongated and/or kinked corner regions. By virtue thereof, the laundry item in mangling is imparted so-called "ears", this negatively affecting the mangling quality.

BRIEF SUMMARY OF THE INVENTION

The invention is therefore based on the object of achieving a method and a device for feeding laundry items to laundry treatment installation, in particular a mangle, which lead to an improved quality of the treatment, specifically preferably without any decrease in the treatment throughput.

A method for achieving said object is a method for feeding laundry items to a laundry treatment installation, in particular a mangle, wherein a transverse periphery is stretched by a spreading installation having spreader clamps for holding neighboring corner regions of the transverse periphery of the laundry item and the laundry item herein is spread out, and the spread-out laundry item by way of the stretched front transverse periphery is deposited onto an infeed conveyor or a depositing strip, characterized in that the corner regions, prior to the laundry items being deposited onto the infeed conveyor or the depositing strip, are moved through the spreader clamps to the outermost corner points of said corner regions and/or close to the outermost corner points. It is accordingly provided that the corner regions of the laundry item held by the spreader clamps, prior to the laundry items being deposited onto the infeed conveyor or the depositing strip, are moved through the spreader clamps to close to the corners of said corner regions, in particular the geometric corner points thereof. Corners, in particular tails, that protrude from the spreader clamps are thus avoided. The tails after the depositing of the front periphery, or the transverse periphery, respectively of the laundry item that is held stretched by the spreader clamps, having the peripheral region adjoining thereto, onto the infeed conveyor and/or the depositing strip lead to the ears on the corners which have been mentioned at the outset and which protrude from the contours of the geometric shape of the laundry item and thus to the treatment quality being significantly compromised.

The method can preferably be redefined in that the corner regions of the respective laundry item that are held by the spreader clamps are moved through the spreader clamps so far until an outermost location of each corner, preferably the geometric corner point of the respective corner, reaches a clamping region of the respective spreader clamp. The corners are moved at least so far through the spreader clamps that the outermost locations of said corners are located close to the clamping region of the respective spreader clamp, on account of which a formation of a tail in the depositing of the laundry item from the spreader clamps onto the depositing strip or the infeed conveyor is avoided or significantly reduced.

One advantageous potential design embodiment of the method provides that the clamping region of each spreader clamp is formed between neighboring and preferably mutually communicating clamping members. A clamping member of each spreader clamp is preferably driven in a targeted controlled manner so as to move the respective corner region of the laundry item through the respective spreader clamp.

The clamping members are preferably configured as rolls or clamping rollers, respectively. This enables the respective corner region to be transported through the spreader clamp holding said corner region. The respective corner, in particular the geometric corner point, in each spreader clamp can thus be actuated with this aim. A tail that potentially projects in relation to the spreader clamp is thus at least largely eliminated. Each of the two spreader clamps of a spreader clamp pair can be activated in a mutually individual manner, on account of which even tails of dissimilar lengths in one or the other spreader clamp of each spreader clamp pair can be eliminated in an individual and mutually independent manner.

It can preferably be provided that one of the clamping rollers, preferably a freely rotatable roll or clamping roller, of each spreader clamp is pivoted relative to the roller of the roll or roller pair assigned to said spreader clamp. A simple opening and closing of each spreader clamp is possible in this way. Moreover, each spreader clamp on account of the pivoting of a clamping roller can be open so wide that said spreader clamp can be supplied with a corner region of a laundry item in a simple manner.

A further method for achieving the object mentioned at the outset is a method for feeding laundry items to a laundry treatment installation, in particular a mangle, wherein a respective laundry item by way of a peripheral portion that lies between two neighboring corners of a transverse periphery is deposited on at least one loading station, is transported beyond an end of the loading station until two neighboring corner regions of an opposite transverse edge of the laundry item are configured at the end of the loading station and said corner regions of the laundry item are gripped, characterized in that the transporting speed of the laundry item in the respective loading station is reduced prior to the corner regions of the laundry item being gripped. According to this method it is provided that the transporting speed of the laundry item through the respective loading station is reduced prior to the opposite corners of a laundry item that delimit a transverse periphery of said laundry item being gripped by transfer or spreader clamps. A reliable and above all accurate gripping of the neighboring corners of the laundry item is enabled on account thereof. It is thus ensured in particular that no tails or only very short tails are created when the corner regions of the laundry item are gripped.

A potential refinement of the method provides that the point in time at which the outermost corners, in particular the geometric corner points, of the corner regions of the laundry item are released from the loading station is ascertained, in particular detected. Said point in time is preferably detected in an individual and mutually independent manner for each corner, or outermost location, respectively, of each corner region of the laundry item. Said locations can be precisely ascertained on account thereof, even when the locations of different corner regions of the laundry item are released not simultaneously but successively from the loading station. Ascertaining the point in time of the release of each outermost corner or outermost location of opposite corner regions of a transverse edge of the laundry item from the loading station in an individual manner permits a reliable precise gripping of the two opposite corners of the transverse edge of the laundry item at the outermost location without any notable formation of a tail.

It is preferably provided that the transporting speed through the loading station is reduced prior to the corners of the laundry item being released from the loading station, in particular prior to the first corner of the transverse edge of the laundry item being released from the loading station. On account thereof, the transporting speed of the laundry item through the loading station is reduced in a timely manner prior to the release of the respective corner of the laundry item from the loading station being established, such that the point in time of the release of the respective corner of the laundry item from the loading station can be detected in a reliable and above all accurate manner.

A device for achieving the object mentioned at the outset is a device for feeding laundry items to a laundry treatment installation, in particular a mangle, having an infeed conveyor for transporting spread-out laundry items in the feeding direction to the laundry treatment installation, optionally to a depositing strip that is assigned to the infeed conveyor, and a spreading installation for spreading out and subsequently depositing the laundry item on the infeed conveyor, or the depositing strip assigned to the latter, respectively, said spreading installation having spreader clamps that are repositionable transversely to the infeed direction, characterized in that the spreader clamps have conveying members for moving or repositioning, respectively, the corner regions of the respective laundry item that are held by said spreader clamps. Accordingly, the spreader clamps of the spreading installation are assigned conveying means for moving, or repositioning, the corner regions on opposite ends of a transverse edge of the laundry item that are held by the spreader clamps. The conveying means of the spreader clamps enable the corner regions of the laundry item that are held by said spreader clamps to be transported through the spreader clamps so far until tails of the corner regions of the laundry item that protrude from the spreader clamps are no longer present, or the tails are at least almost eliminated. Such tails can then no longer negatively influence the appearance of the treated laundry item, in particular of the mangled laundry item. The treatment quality of the respective laundry item is significantly improved on account thereof.

It is preferably provided that each spreader clamp has a pair of rolls or rollers for tightly clamping in each case one corner region, or a corner, respectively, of the laundry item, wherein at least one of the rolls is rotatingly drivable. A roller pair, or roll pair, respectively, having interacting rollers or rolls which can tightly clamp not only in the respective corner region of the laundry item but can also transport the corner region through a roll nip between the neighboring rolls is thus created. The corner region of the laundry item that is held in a roll pair by way of a targeted drive of at least one roll of each roll pair can be moved so far through the roll nip until no tail or only a small tail protrudes from the roll nip between each roll pair.

One advantageous refinement of the device provides that the rotatingly drivable roll of each roll pair of each one of the spreader clamps is assigned a rotary drive. This herein can be a simple rotary drive which needs to have only a relatively short rotating path. A rotation by the driven roll by part of a full circle typically suffices for the tail to be eliminated or minimized. The rotary drive is preferably configured as a pneumatic or electric rotary drive. However, the rotary drive can also be implemented so as to be mechanical. It is furthermore preferably provided that the rotary drive is configured such that the angular range of the rotation of the driven roll out of position is adjustable. A preliminary adjustment which does not have to be steadily modified during the operation of the device is typically sufficient. This preliminary adjustment can be chosen such that the tail is significantly reduced and only a residual tail which varies within tight limits remains from one laundry item to another. However, it is also conceivable for the angular range of the rotary drive of the driven roll of each spreader clamp to be adjusted in a mutually individual, independent manner, specifically by means of a previously detected size or length, respectively, of the tail.

A further potential design embodiment of the device provides that one of the two rolls of a roll pair of each spreader clamp, preferably a freely rotatable roll of the roll pair of each spreader clamp, is pivotable about a pivot axis of the respective spreader clamp that runs transversely to the rotation axis of said spreader clamp. This permits simple and wider opening of the respective spreader clamp, which permits said spreader clamp to be supplied with a corner region of the respective laundry item in a simple and complication-free manner. The clamping force of the corner region of the laundry item that is held between the roll pair in the spreader clamp can be implemented according to requirements by pivoting the non-driven roll when closing the spreader clamp. An adaptation to dissimilarly thick laundry items is in particular possible. It is also conceivable for only the driven roll to be pivotably configured, or for both rolls to be configured in an opposing pivotable manner such that the respective spreader clamp can be opened in a V-shaped manner.

A further device for achieving the object mentioned at the outset is a device for feeding laundry items to a laundry treatment installation, in particular a mangle, having a plurality of loading stations that are disposed beside one another in a row that runs transversely to the feeding direction of the laundry item to the laundry treatment installation, said laundry treatment installation having in each case one loading conveyor and, when viewed in the feeding direction, disposed downstream of said loading conveyor, corner locators for neighboring corner regions of a transverse periphery of a laundry item, and each corner locator being configured for transporting therethrough a lateral longitudinal peripheral region of the laundry item, characterized in that each corner locator is assigned at least one detection means for a rear transverse periphery or transverse peripheral region and/or rear corners or corner regions of the laundry item, and a deceleration of the transporting speed of the laundry item in the corner locator assigned to the detection means is capable of being triggered by the respective detection means. Accordingly, the corner locators of each loading station have at least one detection means. The detection means is configured so as to detect the rear transverse periphery of the laundry item that runs past the detection means after the front transverse periphery. The transporting speed of the laundry item is then reduced by the detection means by means of a respective control unit or circuit, as soon as the detection means has detected the rear trailing transverse periphery of the laundry item running past. The corner locators can then detect the respective corner region of the laundry item in a reliable and accurate manner at the slow transporting speed.

Each loading station preferably has two corner locators for in each case one lateral periphery, or longitudinal periphery, respectively, of the laundry item that runs and is transported onward in the feeding direction.

Each corner locator has a roll pair having at least one individually rotatingly drivable roll. The respective lateral periphery, or longitudinal periphery, respectively, having a narrow lateral region, or longitudinal region, of the laundry item that is contiguous to said lateral periphery, or longitudinal periphery, respectively, is transported through the roll pair. On account thereof, the corner locator can reliably grip the corner of the trailing lower transverse periphery of the laundry item assigned to said corner locator.

One advantageous potential refinement of the device provides that the roll pair of each corner locator is assigned a dedicated detection means, preferably a light-barrier-type detection means. On account thereof, it is ascertainable when the respective lateral periphery, or longitudinal periphery, respectively of the laundry item has run through the roll pair and a lower corner of the laundry item is located between the roll pair. The detection means preferably enables the rear end of the lateral periphery, or of the longitudinal periphery, respectively, of the laundry item to be established, this corresponding to a lower corner region of the laundry item. A corner, preferably a geometric corner point, of the laundry item can thus be detected and fixed by the corner locator in a very reliable and accurate manner, without a notable tail projecting in relation to the roll nip of the roll pair of each corner locator.

BRIEF DESCRIPTION OF THE DRAWINGS

Preferred exemplary embodiments of the invention will be explained in more detail hereunder by means of the drawing in which.

DETAILED DESCRIPTION OF PREFERRED EMBODIMENTS

Figure 1:
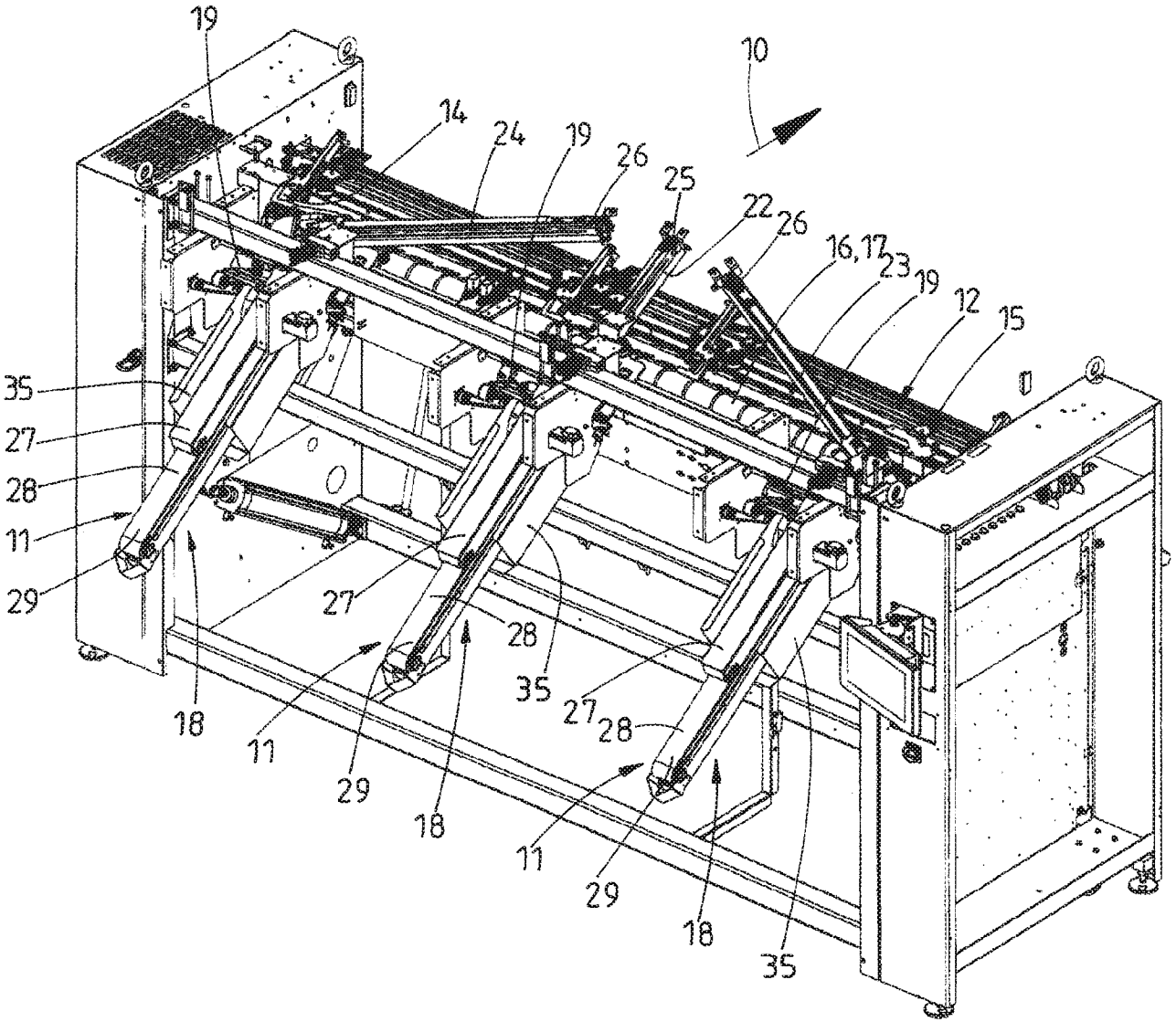
FIG. 1 shows a perspective overall view of a device configured as an input machine.
Figure 2:
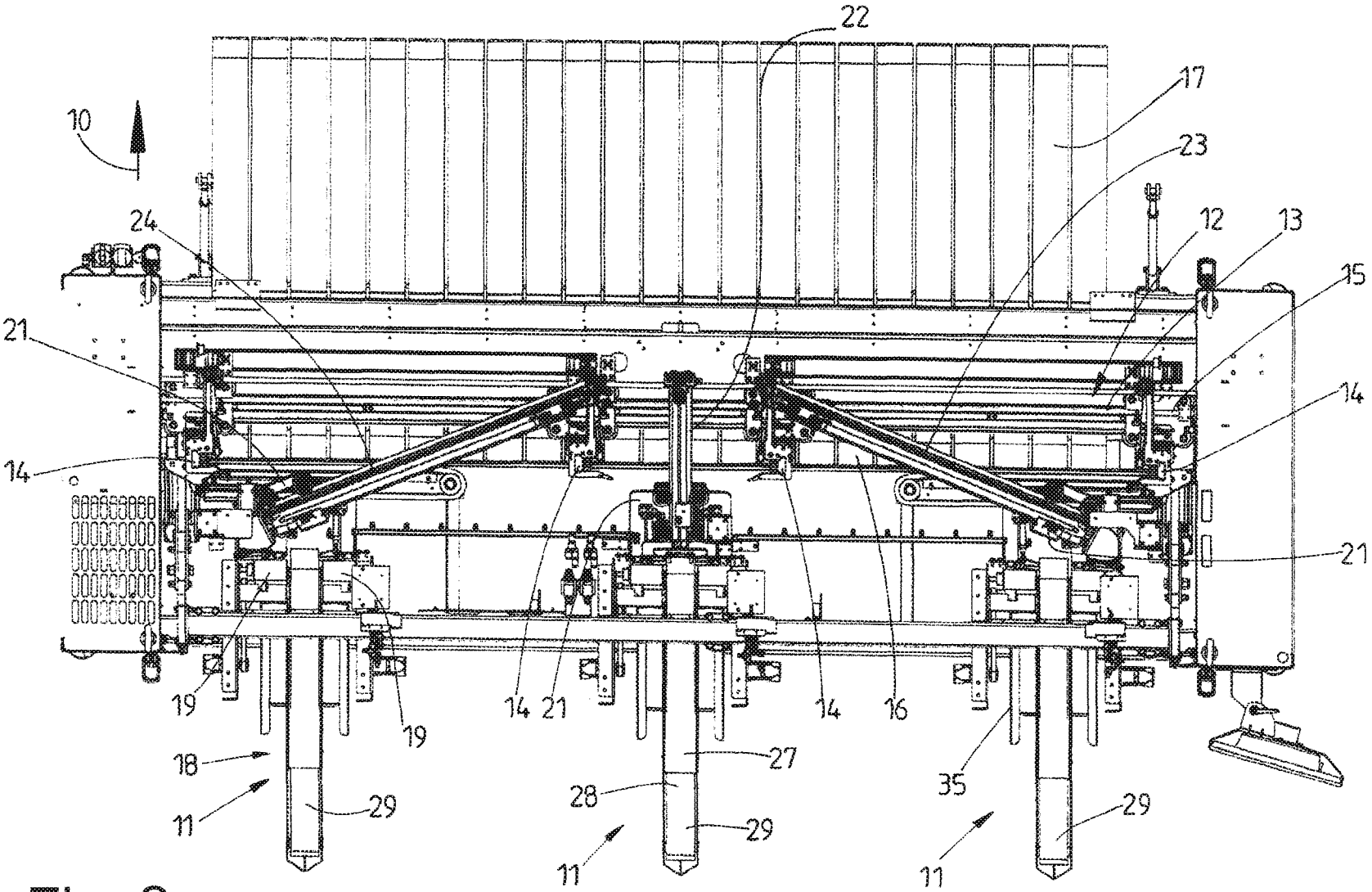
FIG. 2 shows a plan view of the input machine of FIG. 1.
Figure 3:
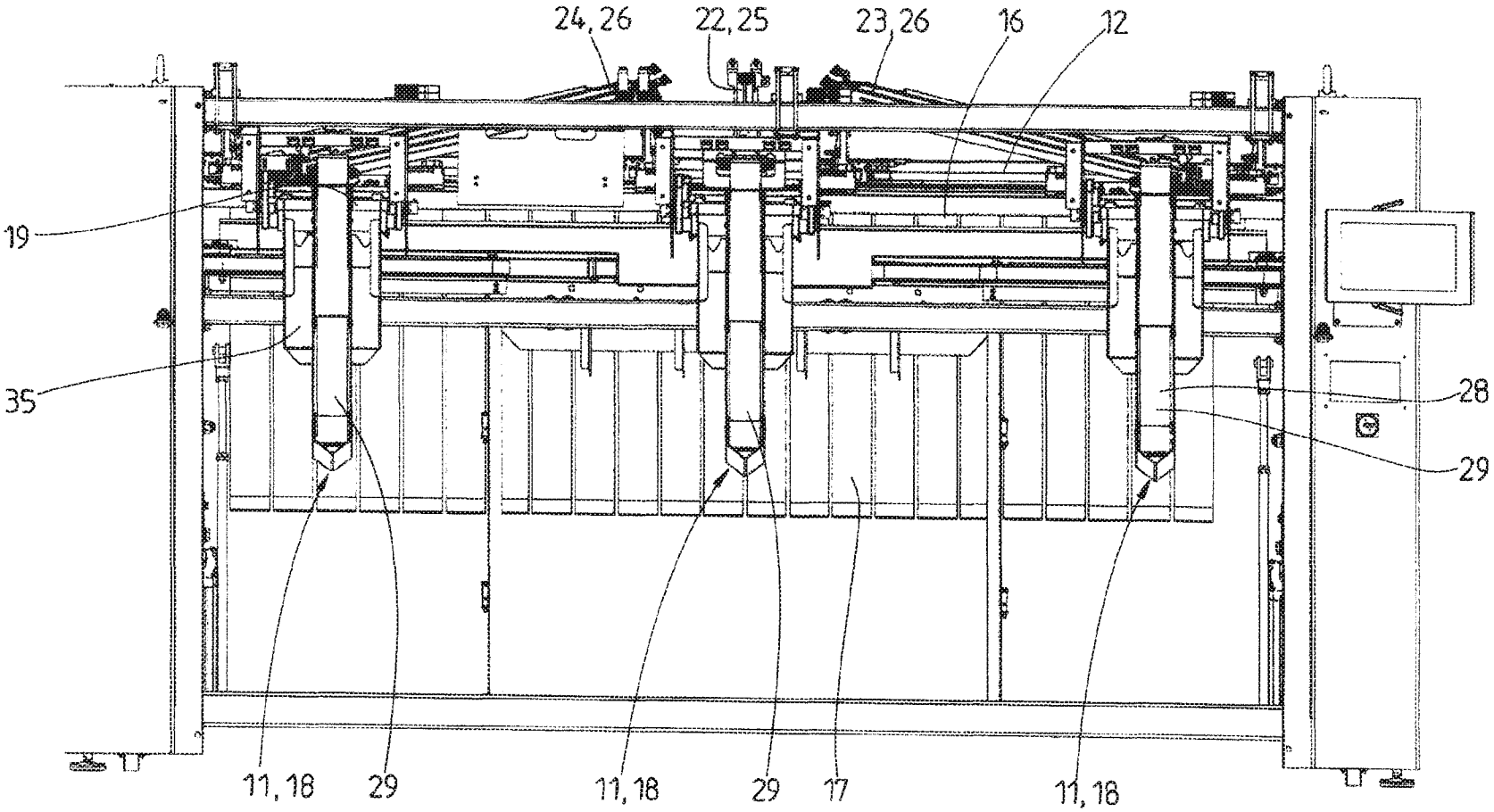
FIG. 3 shows a front view of the input machine of FIGS. 1 and 2.
Figure 4:
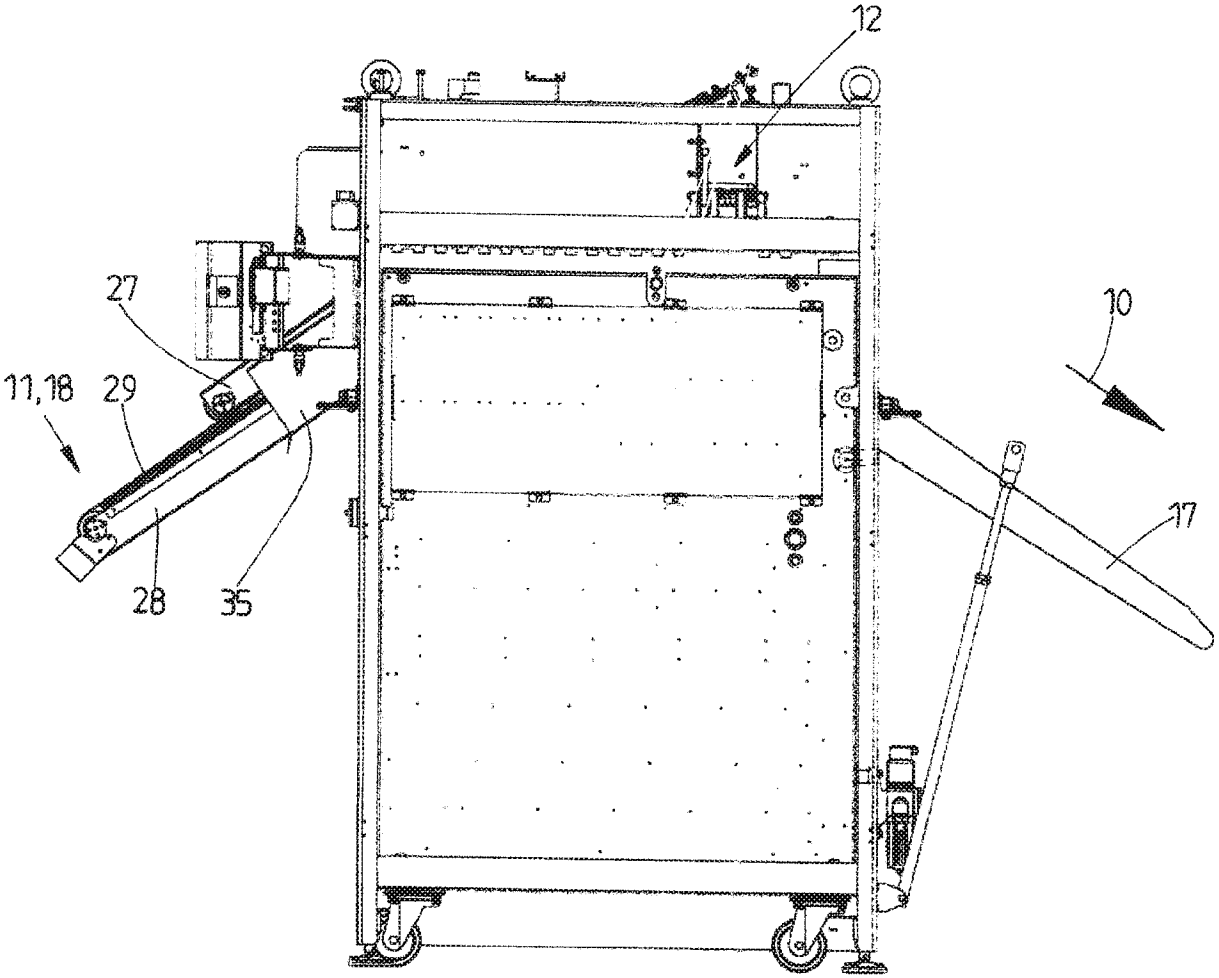
FIG. 4 shows a lateral view of the input machine of FIGS. 1 to 3.
Figure 5:
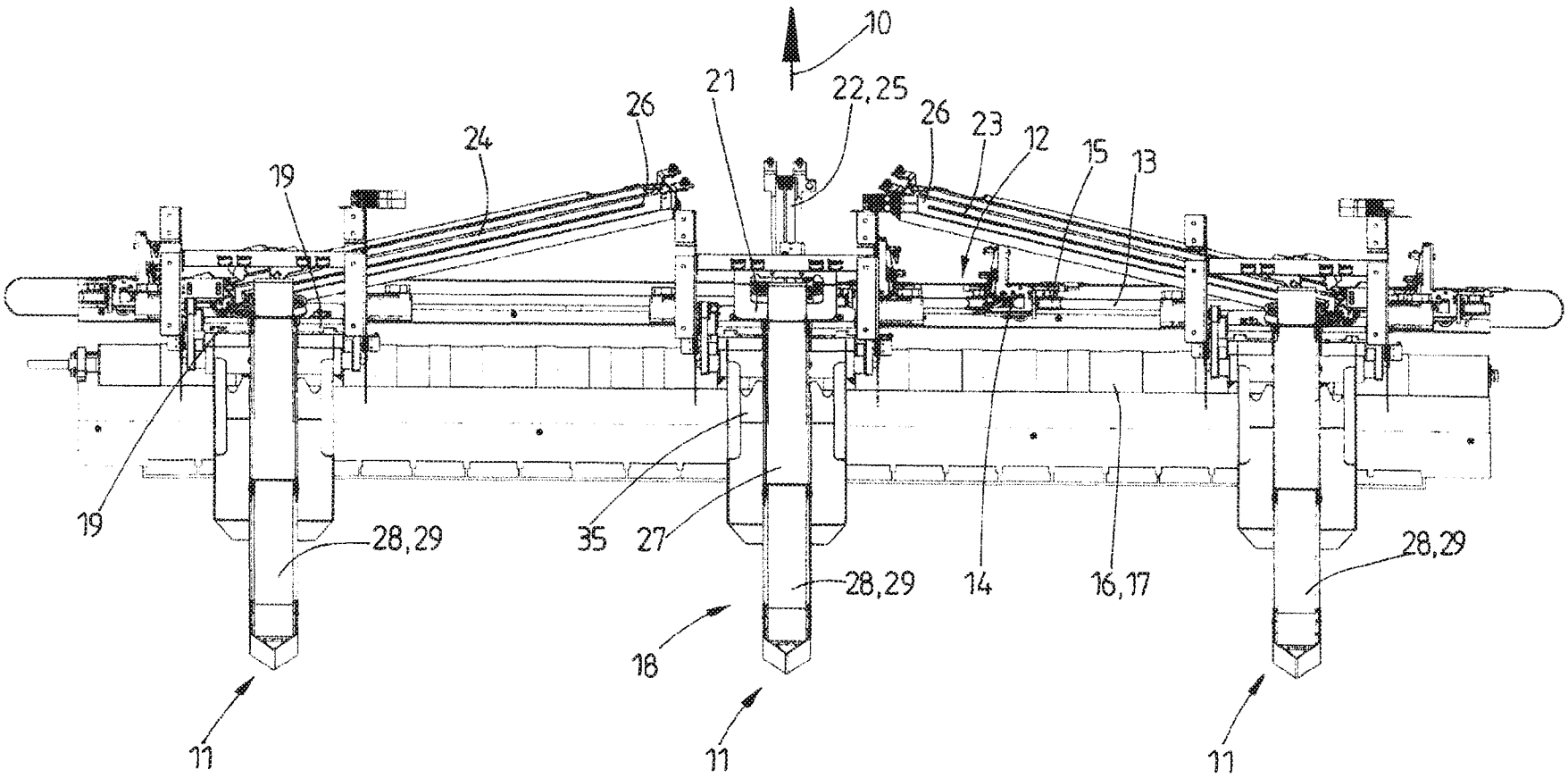
FIG. 5 shows a front view of a partially illustrated input machine in a basic position.
Figure 6:
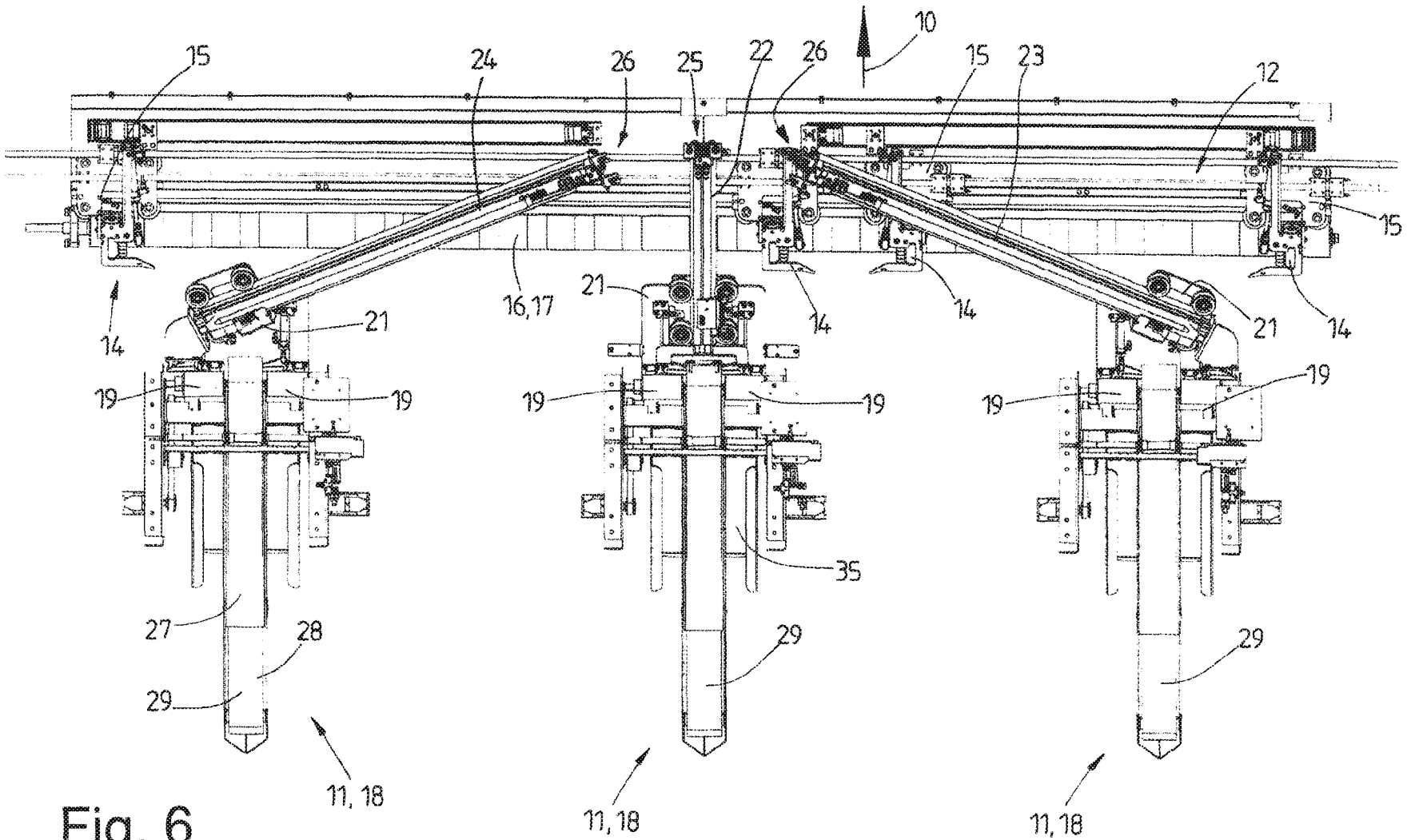
FIG. 6 shows the input machine of FIG. 5 in a plan view.

The figures show a device configured as an input machine. The input machine is completely illustrated in FIGS. 1 to 4. The input machine shown serves for feeding laundry items (not illustrated), specifically mainly flat laundry items such as bed sheets, bedcovers, pillow covers, hand towels, tablecloths and similar in the feeding direction 10 to a mangle (not shown in the figures). The device shown can also serve for feeding laundry items to other laundry treatment installations, for example folding machines.

The device, or input machine, respectively, shown has three loading stations 11 of identical configuration. The three loading stations 11 are disposed at an identical mutual spacing in a row that runs transversely to the feeding direction 10 on the front side of the input machine. The central loading station 11 in the case of the input machine shown is located in the center of said input machine. The two other loading stations 11 are disposed so as to be eccentric on opposite sides of the central loading station 11. The invention is also suitable for input machines having a larger or smaller number of loading stations 11, specifically also for input machines having only a single loading station 11.

When viewed in the feeding direction 10, the loading station 11 is followed by a spreading installation 12. The spreading installation 12 has a horizontal rail 13 which runs transversely to the feeding direction 10 and on which carriages 15 that in each case support one spreader clamp 14 are repositionable transversely to the feeding direction 10. In the case of the device shown, four spreader clamps 14 of preferably identical configuration, having each case one dedicated carriage 15 are provided. However, it is also conceivable that the spreading installation 12 has only two spreader clamps 14 having carriages 15. Two spreader clamps 14 having a mutual mirror-imaged arrangement form in each case one spreader clamp pair for neighboring corners of a transverse edge of the laundry item that in the feeding direction 10 is the leading transverse edge. The spreader clamps 14 of each pair are capable of being converged and diverged transversely to the feeding direction 10. The two spreader clamps 14 of one pair in the converged state acquire neighboring corners of the front transverse periphery of a laundry item. The front transverse periphery of the laundry item for spreading out the laundry item below the spreading installation 12 is spread or stretched, respectively, by way of laterally repositioning and diverging the spreader clamps 14 of the respective spreader clamp pair. Moreover, the laundry item by the spreader clamps 14 of the respective spreader clamp pair is centered, or aligned so as to be central, in relation to the center of the device.

When viewed in the feeding direction 10, the spreading installation 12 is followed by an infeed conveyor 16. The laundry item that is spread out and aligned so as to be central by the spreading installation 12 by way of the stretched leading transverse periphery is transferred by the spreader clamps 14 of the spreader clamp pair to a front end 16 of the infeed conveyor 17. This is performed by depositing a front stretched transverse peripheral region of the laundry item so as to be central on the section of the upper lead of the infeed conveyor 17 that is located in the front end 16 of the infeed conveyor 17. The center of the laundry item herein is deposited onto the center of the infeed conveyor 17. The center of the infeed conveyor 17 lies in a vertical longitudinal central plane of the input machine that runs in the feeding direction 10.

Alternatively, it is conceivable for the spread-out laundry item by way of the stretched front transverse periphery to not be directly deposited from the spreading installation 12 onto the infeed conveyor 17 but to be placed so as to be central on a deep depositing strip assigned to said infeed conveyor 17, the front transverse periphery of the laundry item in the spread-out and/or stretched state subsequently being placed so as to be likewise central on the upper lead of the infeed conveyor 17.

The laundry item that lies spread-out and/or tautly stretched on the infeed conveyor 17 is transported from the latter to the mangle (not shown in the figures) or another laundry treatment installation.

Each loading station 11 has a loading conveyor 18 which transports the laundry item in the feeding direction 10, and two subsequent corner locators 19 in each case for neighboring corners, or corner regions, respectively, of a second originally rear transverse periphery of the laundry item.

In the case of the device, or input machine, respectively, shown here transfer clamps 20 are provided between the two corner locators 19 of each loading station 11 and the spreading installation 12. The two transfer clamps 20 that are assigned to each loading station 11 are combined so as to form a transfer clamp pair 21. On account thereof, the transfer clamps 20 form a double clamp for in each case one of the opposite corners of the transverse periphery of the laundry item.

The transfer clamp pair 21 of each loading station 11 by way of a carriage is repositionable on a rail 22, 23, 24. The rail 22 of the central loading station 11 runs so as to be rectilinear in the feeding direction 10 along the center of the input machine and of the infeed conveyor 17. The rail 22 runs so as to be directed upward in the feeding direction 10. Longer rails 23, 24 run obliquely upward from the outer loading stations 11 in the direction toward the spreading installation 12. Both rails 23, 24 are of identical length, but are directed dissimilarly such that the rear ends 25 thereof, when viewed in the feeding direction 10, are directed toward the center of the input machine but terminate ahead of the center.

Each of the loading conveyors 18 of identical configuration of the loading station 11 has two narrow belt conveyors 27, 28 of identical width, having in each case at least one revolving conveyor belt. The belt conveyors 27, 28 for forming a sandwich conveyor are disposed on top of one another. The upper belt conveyor 27 is shorter than the lower belt conveyor 28, wherein the upper belt conveyor 27, when viewed in the feeding direction 10, for forming an exposed front region of the upper lead of the lower belt conveyor 28 lies behind the beginning of the lower belt conveyor 28, said lower belt conveyor 28 thus forming a depositing region 29 for a respective laundry item.

An ideally central, narrow transverse peripheral portion that lies between neighboring corners of the front transverse periphery of the laundry item is placed onto the depositing region 29 of the lower belt conveyor 28 in order for the input machine to be loaded in the region of the respective loading station 11. Only the shorter upper belt conveyor 27 is preferably driven, specifically on a deflection drum at the rear end of the belt conveyor 27, when viewed in the feeding direction 10, for example. The conveyor belt of the longer lower belt conveyor 28 is indirectly driven by being entrained by the conveyor belt of the driven shorter belt conveyor 27, or by part of the laundry item that lies between the upper lead of the lower belt conveyor and the lower lead of the upper belt conveyor 27, respectively.

The corner locators 19 of the respective loading station 11, illustrated above all in FIGS. 11 to 15, are assigned to a rear end 30 of the longer lower belt conveyor 28, when viewed in the feeding direction 10, and specifically on both sides beside the rear end 30 of the belt conveyor 28 and partially therebehind (FIG. 14). Each of the corner locators 19 of preferably identical configuration, but on account of the disposal on opposite sides of the end 30 of the belt conveyor 28 of mirror-imaged orientation, has two rolls 31, 32 which conjointly form a roll pair having parallel longitudinal central axes, or rotation axes, respectively. A roll nip 33 is formed between the rolls 31, 32 of the roll pair. The rolls 31 and 32 of each corner locator 19 are disposed on opposite sides of the end 30 of the belt conveyor 28 in such a manner that the roll nips 33 thereof lie in a common horizontal line which runs transversely to the feeding direction 10 and parallel with the rail 13 of the spreading installation 12.

One roll 31 of each corner locator 19 is rotatingly drivable. Said rolls 31 that are in each case driven in a mutually independent and separate manner on both sides of the deflection drum at the rear end 30 of the belt conveyor 28 lie on a common line that is transverse to the feeding direction 10. The rotation axes of the driven rolls 31 and of the deflection drum of the belt conveyor 28 lie on said line. The parallel rolls 32 that communicate with the driven rolls 31 of the roll pair of each corner locator 19 are freely rotatable about rotation axes which are located on an imaginary line that is parallel with the line of the rotation axes of the driven rolls 32. The rolls 31 of the corner locators 19 are initially driven at the same rotating speed. This rotating speed corresponds to the rotating speed of the deflection drum of the conveyor belt of the belt conveyor 28 such that synchronous running of the parts of the laundry item that are located in the region of the belt conveyor 28 and of the rolls 31, 32 is provided.

Figure 12:
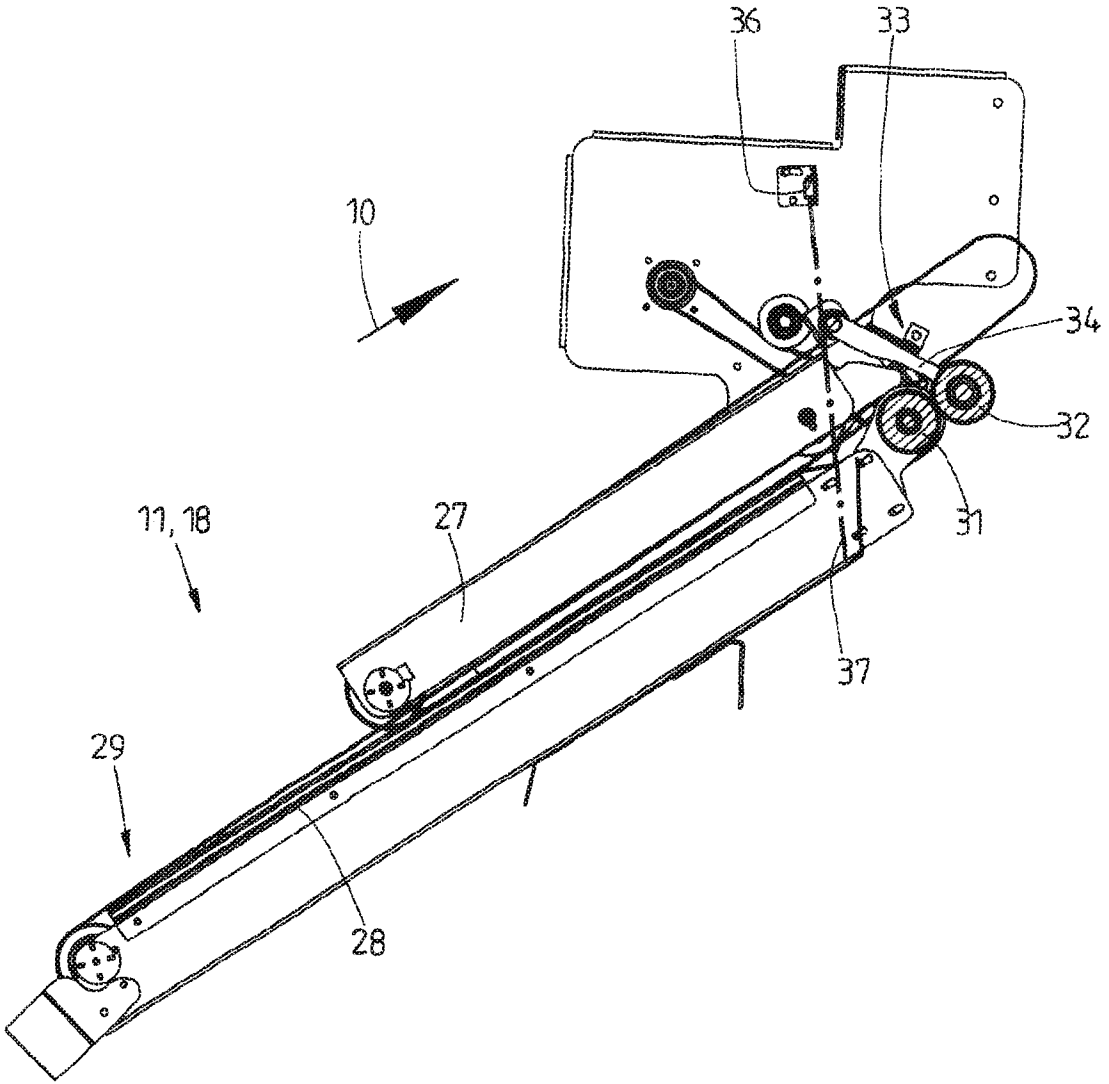
FIG. 12 shows a partially sectional lateral view of the loading station of FIG. 11.
Figure 13:
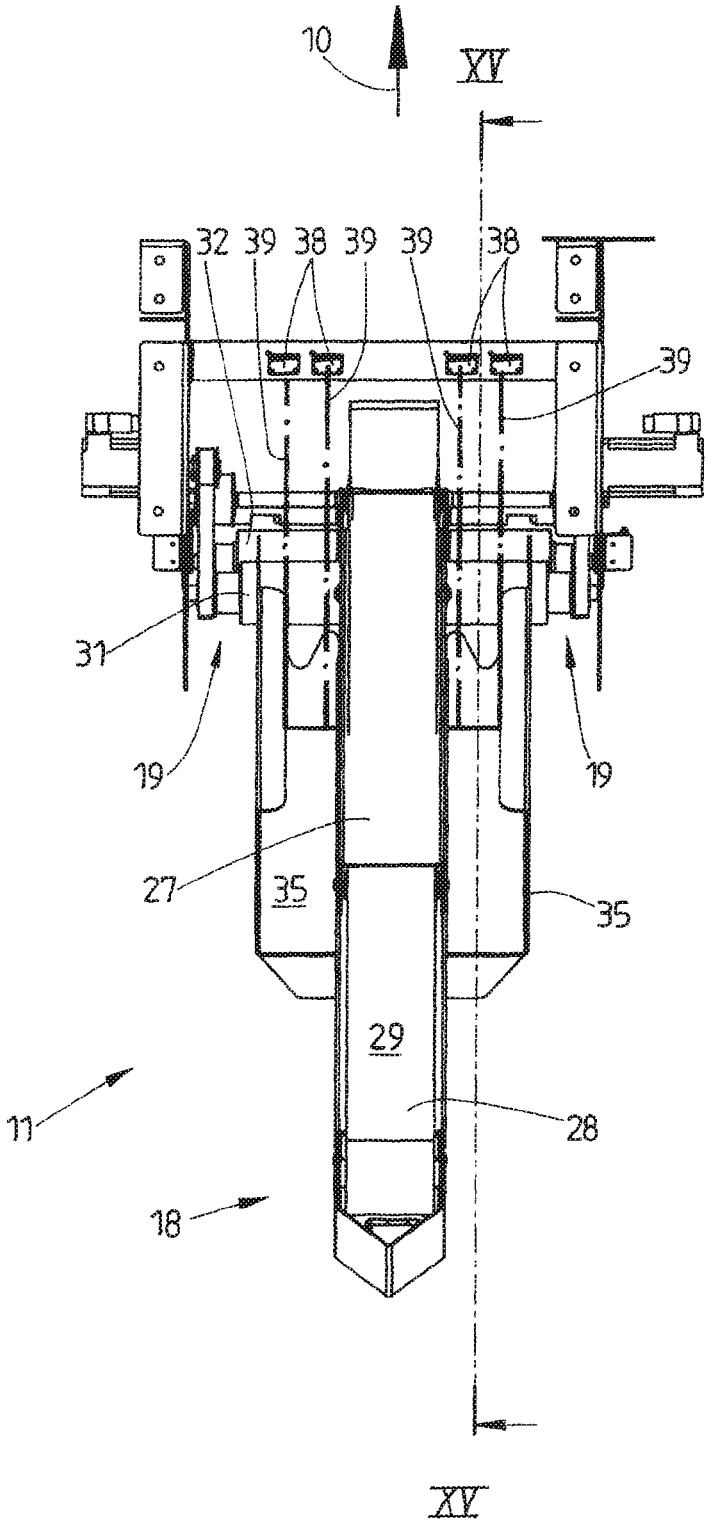
FIG. 13 shows a plan view of the loading station of FIGS. 11 and 12.

The driven rolls 31, exactly like the deflection drum at the end 30 of the belt conveyor 28, are disposed so as to be locationally fixed. As opposed thereto, the rolls 32 are mounted so as to be movable on a pendulum arm (FIG. 12). The non-driven rolls 32, either by the dead weight thereof or by a spring pre-tensioning of the pendulum arms 34, are urged in the direction toward the driven rolls 32 and pressed against the latter such that a part of the respective laundry item that is located between each roll pair from a roll 31, 32 is jammed in the roll nip 33 of each corner locator 19, and the part, for example a corner region or a corner of the laundry item, that in the case of stationary rolls 31, 32 is located in the respective roll nip 33 is held in the manner of a clamp.

Somewhat spaced apart so as to be behind the beginning of the upper belt conveyor 27, each loading conveyor 18 is surrounded by a guide duct which in the exemplary embodiment shown is configured as a U-shaped channel 35 that is largely open at the top. The laundry item, in particular the opposite lateral peripheries, or longitudinal peripheries, respectively, of said laundry item, are pulled through the channel 35 when transported onward in the feeding direction 10 between the belt conveyors 27 and 28, and on account thereof directed in a guided manner to the corner locators 19 that are disposed behind the channel 35 on both sides beside the loading conveyor 18. In this way, opposite lateral peripheries, or longitudinal peripheries, respectively, of the laundry item, running in the feeding direction 10, make their way into the roll nip 33 between the pair or rolls 31 and 32 of each corner locator 19.

Detection means 36 are disposed behind the channel 35 that is open at both ends, when viewed in the feeding direction 10, so as to be above the ends of said channel 35 that point toward each corner locator 19. The detection means 36 in the exemplary embodiment shown are line sensors which acoustically or optically generate an approximately perpendicular sensor line 37. Two parallel detection means 36 are disposed at a minor spacing beside each side of the lower belt conveyor 28 in the exemplary embodiment shown. This is provided for the purpose of redundancy. However, it is also conceivable for only a single detection means 36 to be provided on each side of the belt conveyor. The sensor lines 37 of the detection means 36 run along in front of the front rolls 31 of the corner locators 19 in the direction toward the base of the channel 35. The detection means 36, or the sensor lines 37, respectively, detect the presence or the absence, respectively, of a lateral peripheral region of the laundry item on each side of the belt conveyor 28 and in front of the respective corner locator 19. The sensor lines 37 of the detection means 36 ascertain the rear ends of the lateral peripheral regions of the respective laundry item in front of the corner locator 19 on each side of the belt conveyor 28.

As soon as the sensor line 37 of at least one detection means 36 establishes that the respective lateral peripheral region of the laundry item has run through in front of the rolls 31, 32 of the respective corner locator 19, at least one detection means 36 activates the drive of the roll 31 of the respective corner locator 19 in such a manner that the circumferential speed, or the rotating speed, respectively, of the roll 31 is reduced on the respective side of the belt conveyor 28. The respective end portion of the lateral peripheral region of the laundry item in the region of the corner locator 19 on the one or the other side of the belt conveyor 28 is then transported slower through the roll nip 33 of the respective corner locator 19. The end of the respective lateral peripheral region of the laundry item in the respective corner locator 19 can be ascertained in a more reliable and accurate manner on account thereof.

The end of the respective lateral peripheral region of the laundry item in the region of the respective corner locator 19 is thereafter established by other detection means 38 in that in each case at least one such detection means 38 is provided on the outside beside each corner locator 19 on both sides of the belt conveyor 28. The detection means 38 are also configured for generating an acoustic or optical sensor line 39.

Figure 14:
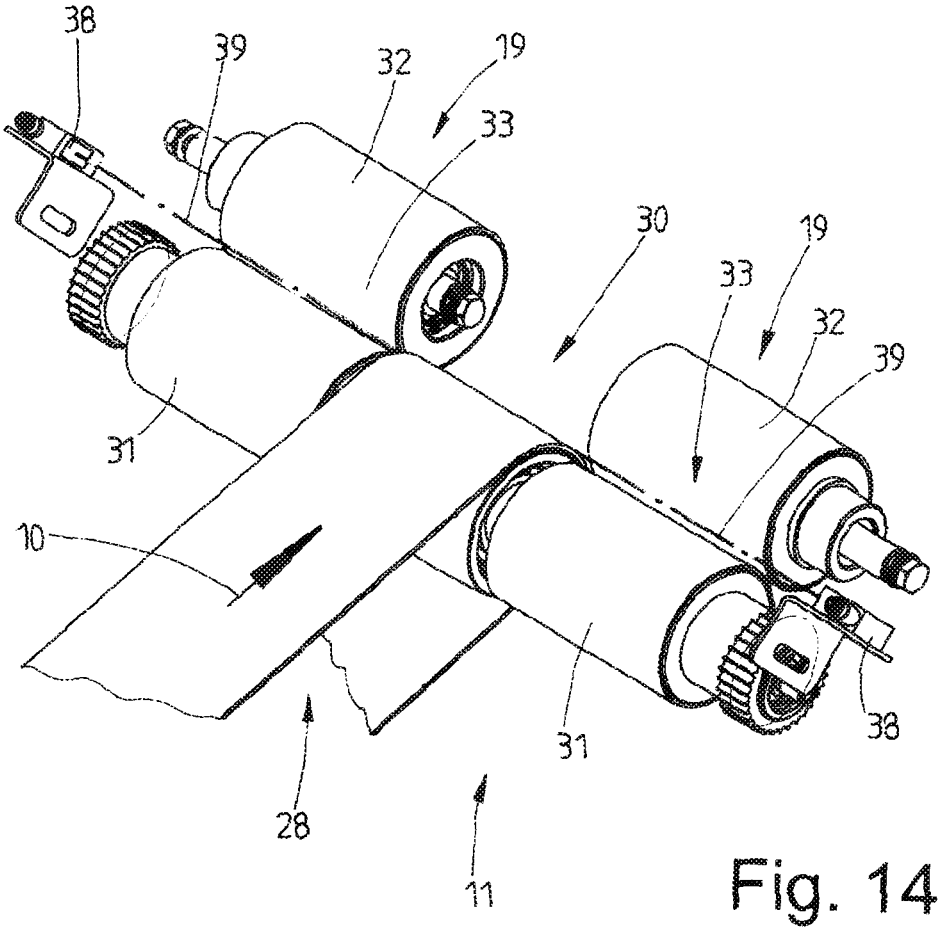
FIG. 14 shows a perspective view of a corner locator of an outer loading station of FIGS. 1 to 13.
Figure 15:
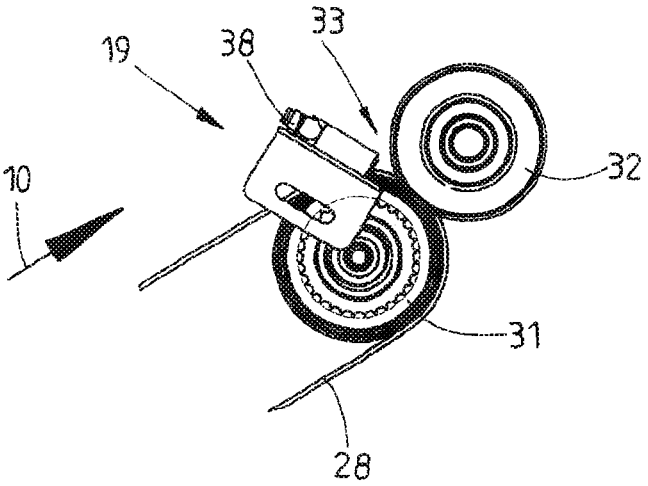
FIG. 15 shows a section XV-XV through the corner locator of FIGS. 13 and 14.

The sensor line 39 of each corner locator 19 runs at a minor spacing above the roll nip 33 so as to be parallel between the rolls 31 and 32 of the respective corner locator 19 (FIGS. 14 and 15). The sensor lines 39 of both corner locators 19 herein lie on a common imaginary horizontal line that is parallel with the rotation axes of the rolls 31 and 32 and thus is transverse to the feeding direction 10, somewhat above and in front of the roll nip 33 of each corner locator. Reflective means (not shown in the figures) are provided at the ends of the sensor lines 39, close to the mutually facing end sides of the rolls 31 and 32 of each corner locator 19, such that the detection means 38 and the sensor lines 39 thereof detect in a mutually independent manner the rearmost end, in particular a geometric corner point of the tail at the ends of the lateral peripheries of the laundry item running past. As a result of the independent detection means 38 of each corner locator 19, an optionally successive running past of the end of the left and the right lateral periphery of the laundry item on the sensor lines 39 is identified in a mutually independent manner. As soon as the running past of a rear end of a lateral peripheral region of the laundry item is detected by the respective sensor line 39 at one or the other corner locator, the drive of the driven roll 31 of the respective corner locator 19 is stopped. A corner of an originally rear transverse periphery is then fixed in the manner of a clamp by each corner locator 19, specifically such that the outermost point of the respective corner of the laundry item is still just in the roll nip 33, but at least just before the latter.

As soon as the two independently operating corner locators 19 have in each case acquired and fixed a corner of the laundry item close to the outermost corner point on opposite sides of the belt conveyor 28 and the drives of the rolls 31 of both corner locators 19 have been deactivated, both corners of the originally lower transverse periphery and the now front transverse periphery of the laundry item are gripped and jammed by the two transfer clamps 20 of the transfer clamp pair 21 that has been moved close to the corner locators 19.

The laundry item which is held on the respective clamp pair by way of opposite corner regions of a now front transverse edge is transferred from said respective transfer clamp pair 21 to two vacant neighboring spreader clamps 14 of the spreading installation 12.

Figure 10:
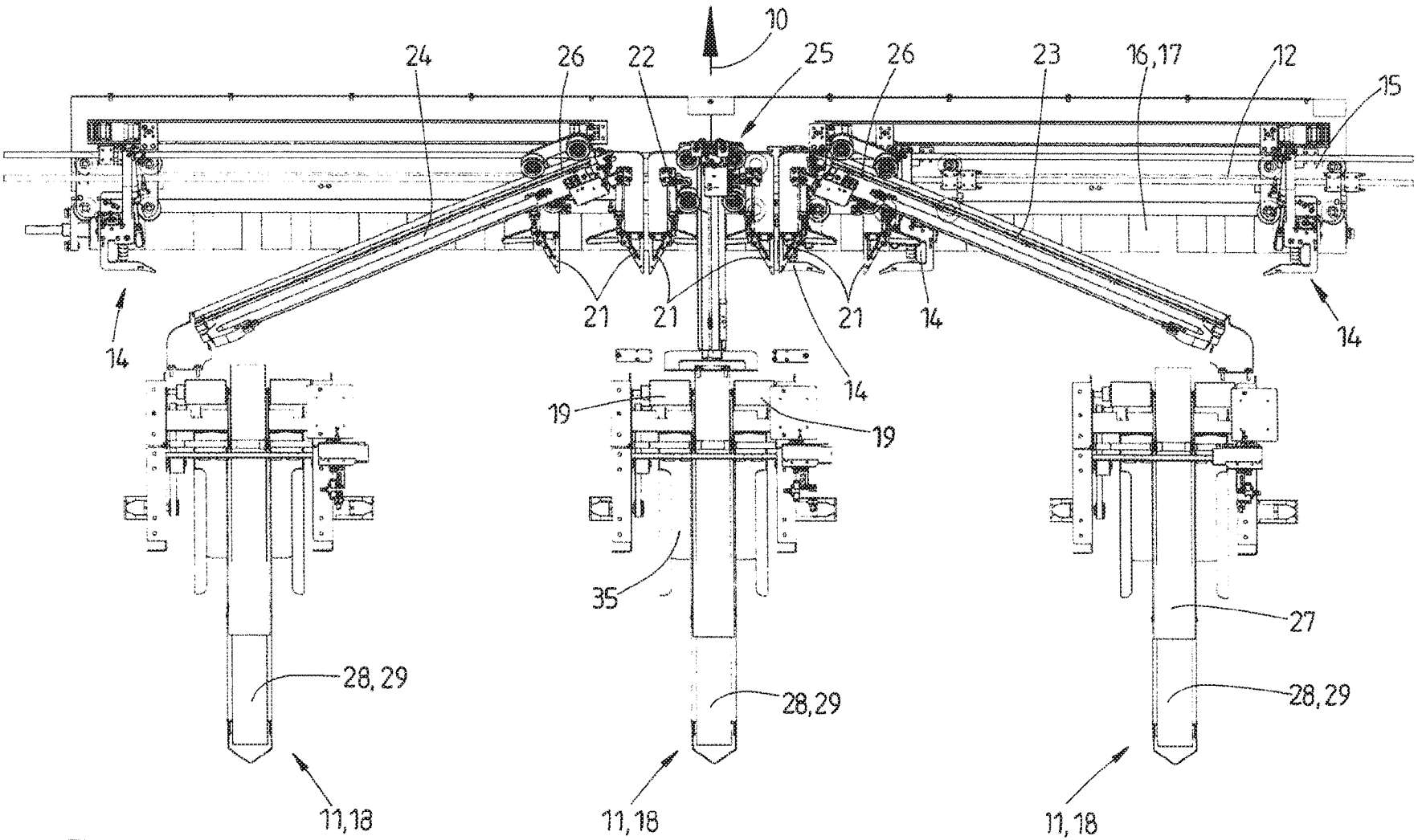
FIG. 10 shows a plan view of a partially illustrated input machine in another operating position.
Figure 11:
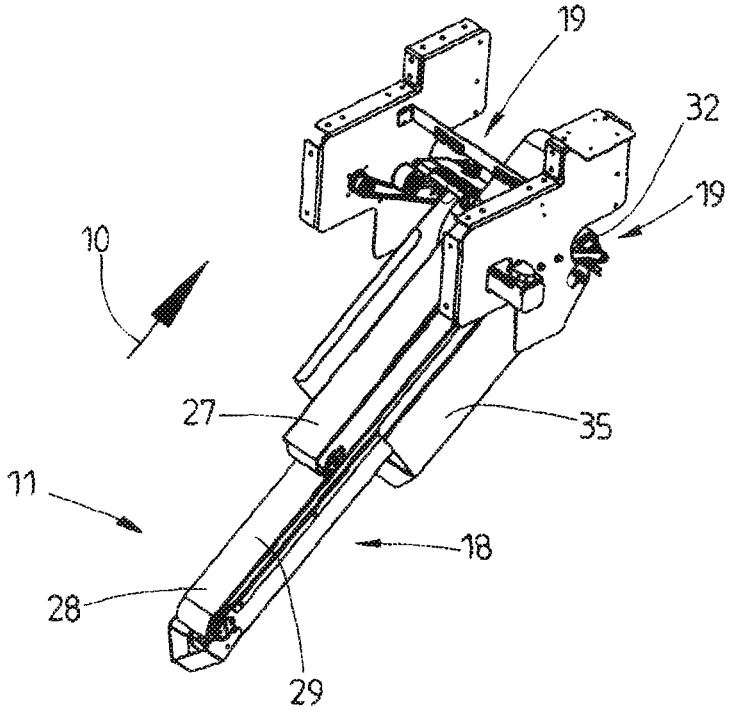
FIG. 11 shows a perspective illustration of a loading station of the input machine of FIGS. 1 to 10.

The transfer clamp pair 21 having the laundry item loaded at the central loading station 11 is repositioned, in particular moved obliquely upward, from the central loading station 11 along the rail 22 that runs in a rectilinear manner in the feeding direction 10 to the upper end 25 of said rail 22. Said end 25 is located in the vertical longitudinal central plane of the device, or input machine, respectively. The laundry item at the end 25 of the rail 22 is transferred from the two transfer clamps 20 of the transfer clamp pair 21 to two spreader clamps 14 of a spreader clamp pair that have been moved to the center of the input machine, said spreader clamps 14 having mutually facing opening sides of the clamping jaws (FIG. 10). Said two spreader clamps 14 are subsequently moved apart in equal measures in opposite directions so as to spread the now upper transfer periphery of the laundry item.

As a result of the transfer of the laundry item to the centrally positioned spreader clamps 14 of the spreader clamp pair, the laundry item after the spreading of the front, or upper, respectively, transverse edge is already centered so as to be central in front of the infeed conveyor 17. The laundry item can then be transferred from the spreader clamps 14 directly to the front end of the infeed conveyor 17 by depositing a transversely directed front peripheral region that adjoins the front transverse edge of the laundry item onto the front region of the infeed conveyor 17 or a depositing strip that is assigned to the infeed conveyor 17.

The laundry items of each of the two outer loading stations 11 are transferred in the same way to two closest vacant spreader clamps 14 of a spreader clamp pair. FIGS. 6 to 9 in the context of the right loading station shown in the figures. This transfer procedure is highlighted by FIGS. 6 to 9 in the context of the right loading station 11 shown in the figures mentioned.

Figure 7:
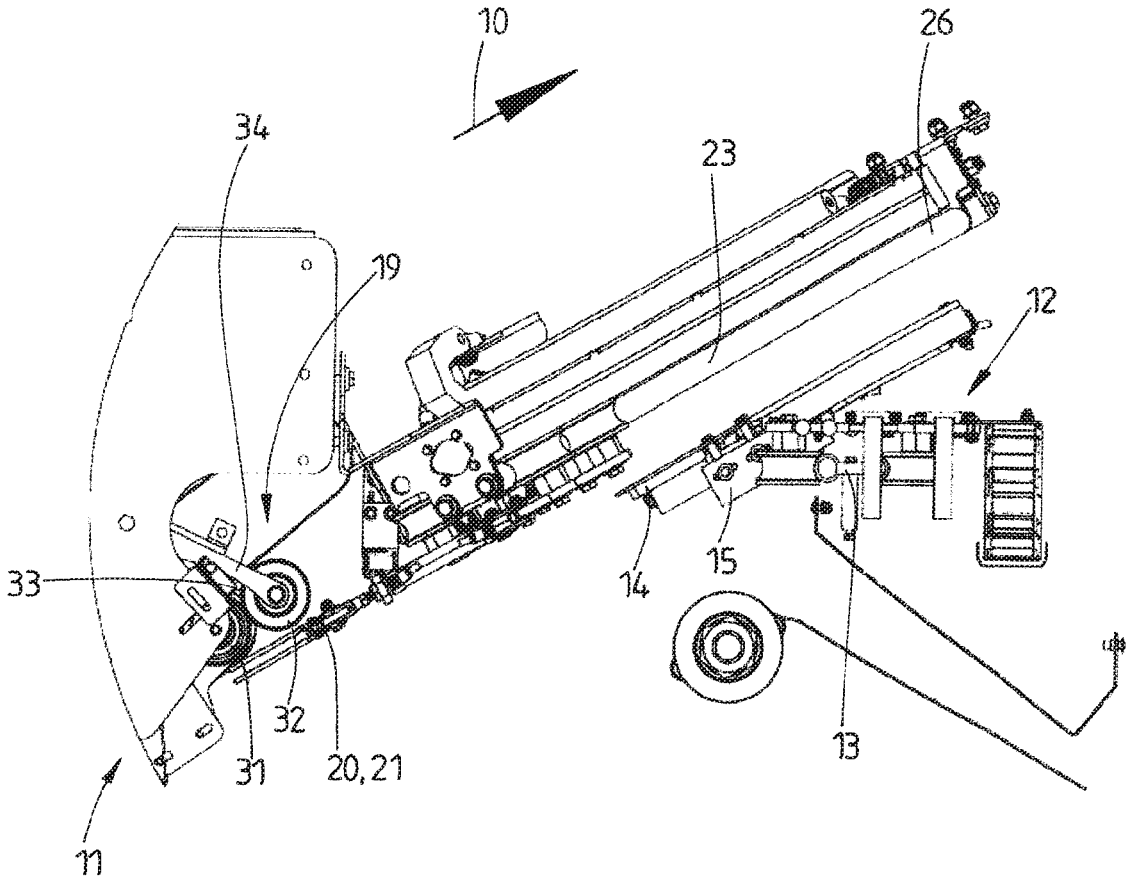
FIG. 7 shows the input machine of FIGS. 5 and 6 in a partially illustrated lateral view.

The transfer clamp pair 21 in the initial position (FIGS. 6 and 7) is located at the outer lower end of the rail 23, behind the two corner locators 19 (FIG. 7). The transfer clamp pair 21 in this position acquires a laundry item from the corner locators 19 such that each transfer clamp 20 holds one corner of the front transverse periphery of the laundry item.

The transfer clamps 20 of the transfer clamp pair 21 are conjointly repositioned on the oblique rail 23 from the initial position to the higher rear end 26 of said rail 23. Said end 26 of the rail 23 is located above the lower end of said rail 23, and so as to be offset from said lower end in the feeding direction 10 toward the spreading installation 12. On account thereof, the rail 23 is obliquely directed in the three-dimensional space, specifically like the rail 24 of the left loading station 11, said rail 24 however being aligned in a mirror image in relation to the rail 23.

Figure 8:
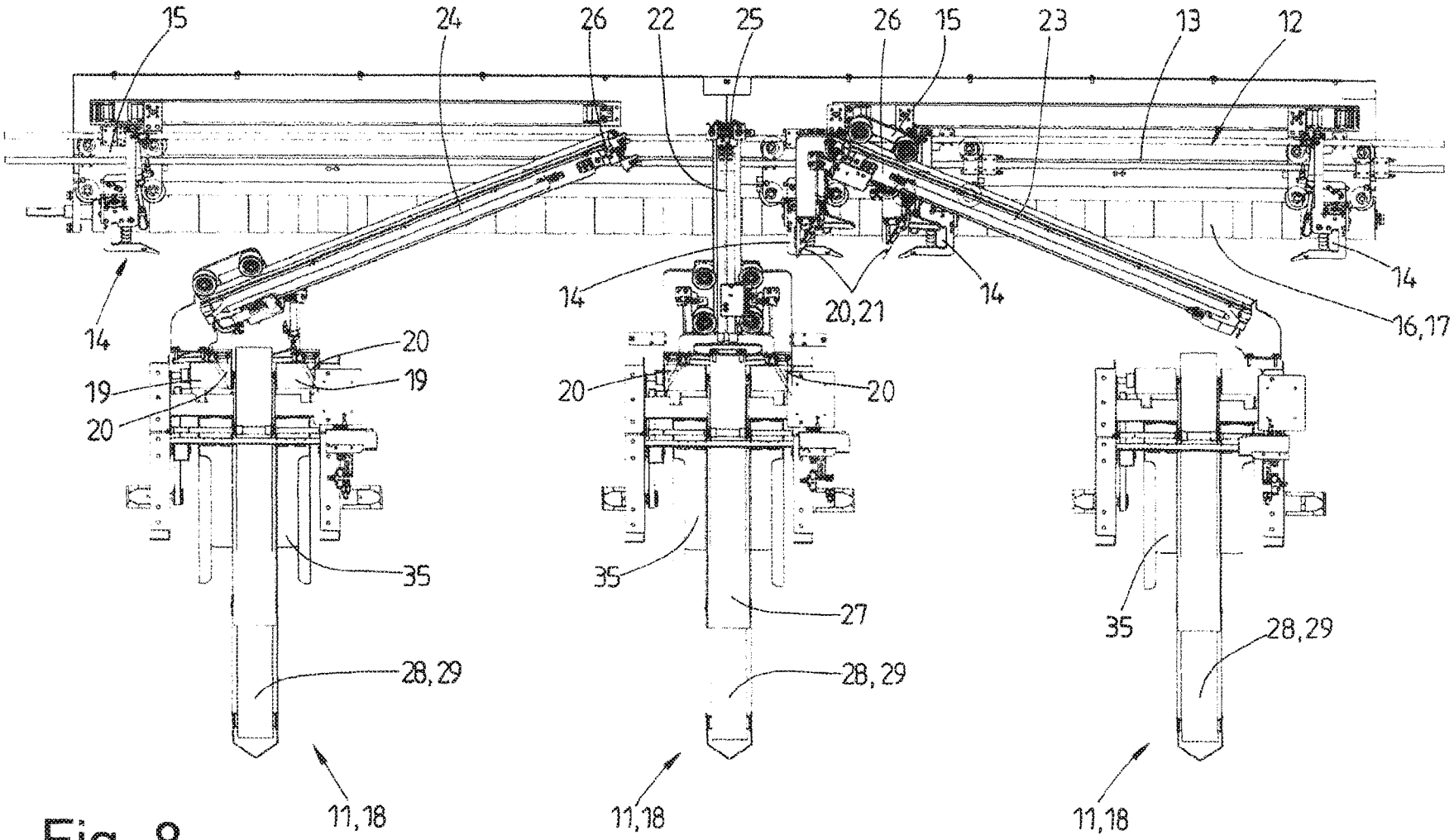
FIG. 8 shows a plan view of a partially illustrated input machine in a transfer position.

The upper rear end 26 of the rail terminates at a spacing ahead of the end 25 of the central rail 22. Therefore, the transfer clamp pair 21 that has been repositioned to the end 26 of the rail 23 is located beside the vertical longitudinal central plane of the input machine, so as to be spaced apart from said vertical longitudinal central plane. A transfer of the laundry item from the transfer clamps 20 of the transfer clamp pair 21 to the spreader clamps 14 of a vacant spreader clamp pair that is next located at the transfer location is performed at this eccentric location, said spreader clamps 14 having already being moved and thus waiting behind the transfer clamp pair 21, or being later moved behind the transfer clamp pair 21 (FIGS. 8 and 9).

Once the spreader clamps 14 of the spreader clamp pair have acquired the laundry item and have fixedly clamped the latter on opposite corner regions of a front transverse edge, the spreader clamps 14 for tautly stretching the front transverse periphery of the laundry item are diverged and simultaneously centered so as to be central in front the infeed conveyor 17. The transfer of the laundry item from the spreader clamps 14 is subsequently performed exactly as has been described above in the context of the transfer of the laundry item to the spreader clamps 14 from the rail 22 of the central loading station 11.

Figure 9:
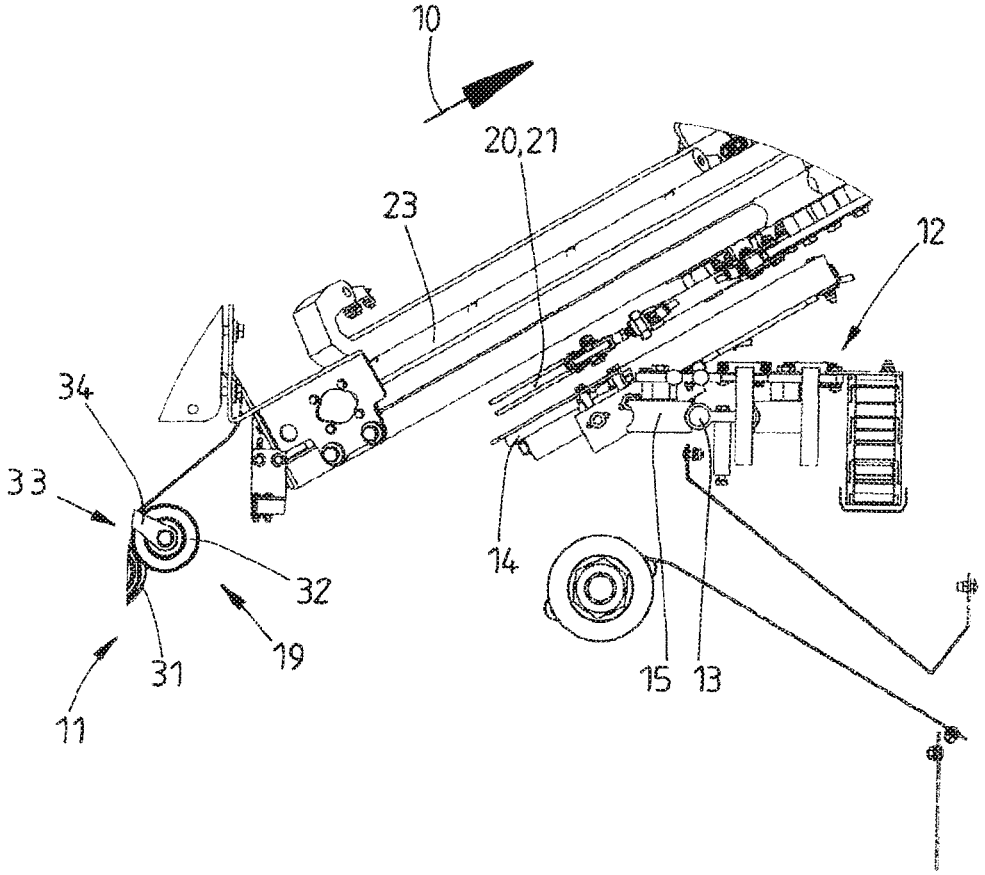
FIG. 9 shows a partially illustrated lateral view of the input machine of FIG. 8.

The transfer clamp pair 21 on each of the rails 22, 23, and 24, and the spreader clamps 14 of the spreading installation 12 lie in two different parallel planes (FIG. 9). However, said planes lie so as to be as close to one another as possible so that the spreader clamps 14 can move past the transfer clamps 20 and the slides thereof, but the transfer of the corners of the respective laundry item from the transfer clamp pair 21 to the spreader clamps 14 is possible in a reliable manner. On account of the transfer clamps 20 being able to run along the spreader clamps 14 it is possible that a plurality or else all of the transfer clamp pairs 21 are located at the upper end 25, 26 of the respective rail 22, 23, or 24, respectively, without said transfer clamps 20 colliding on account thereof (FIG. 10).

Figure 16:
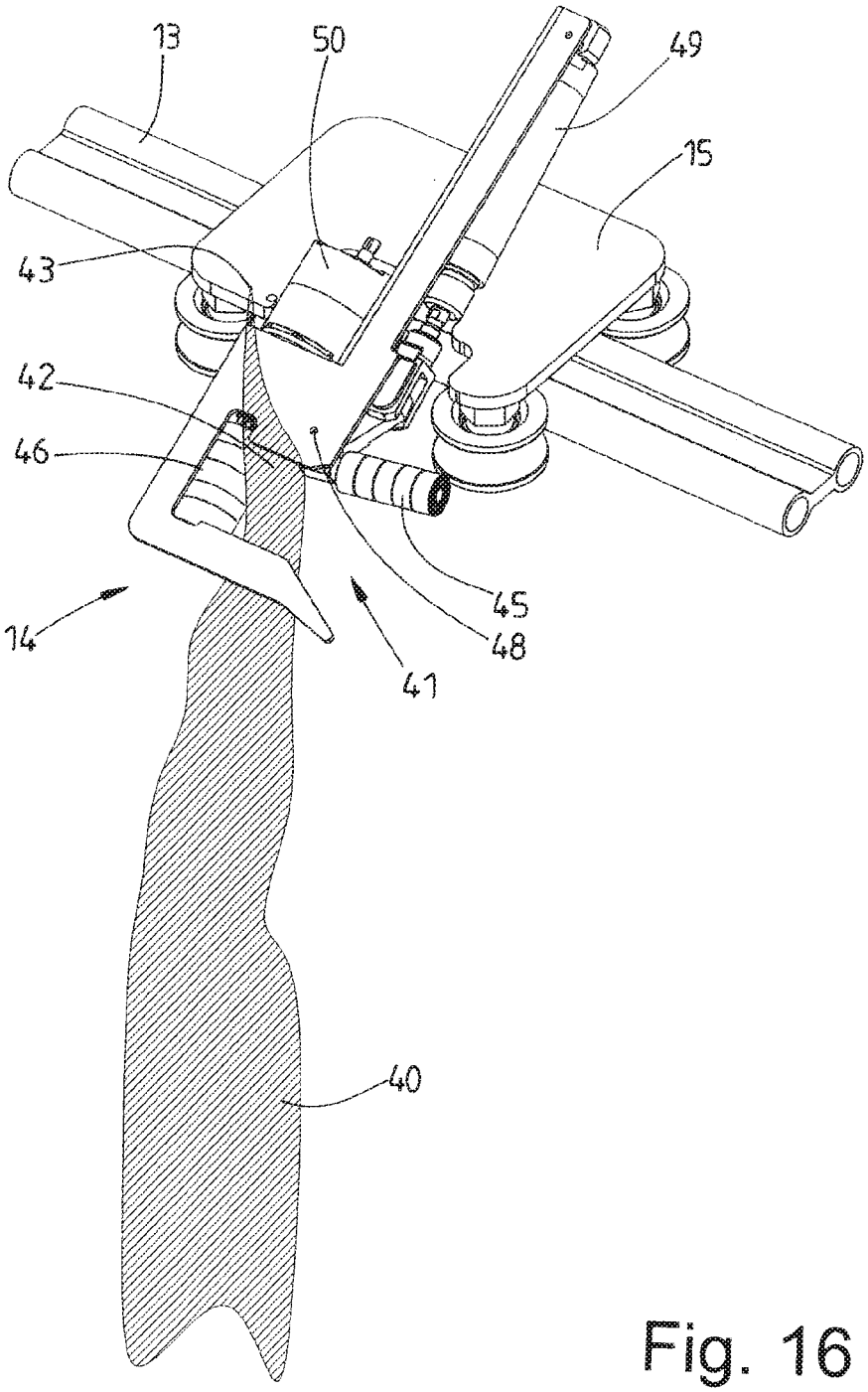
FIG. 16 shows a spreader clamp of a spreading installation in the opened state, having an indicated laundry item, in a perspective illustration.
Figure 17:
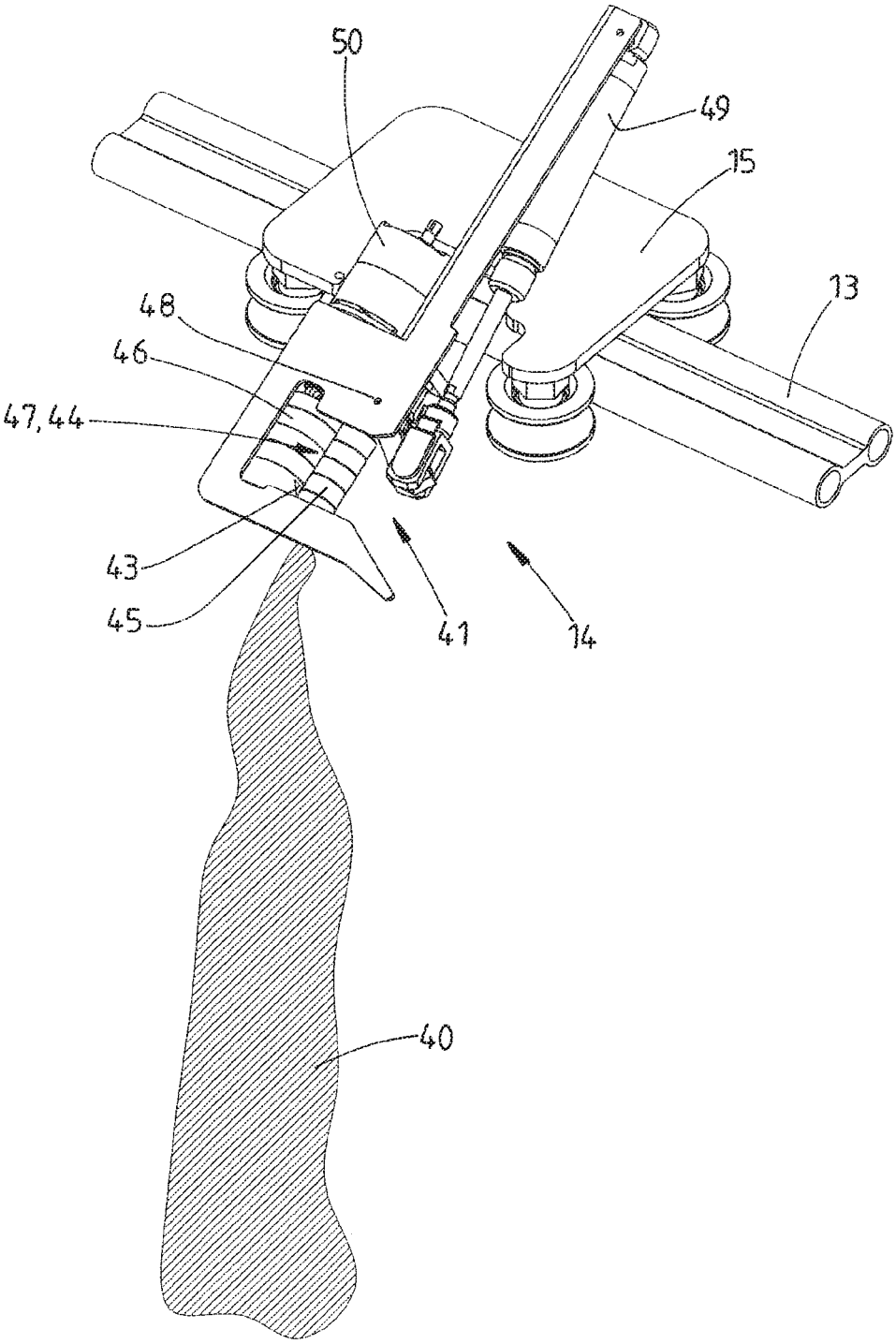
FIG. 17 shows the spreader clamp of FIG. 16 in the closed state.

Each of the spreader clamps 14 is configured in a particularly inventive way. Said configuration is such that after hooking a corner region of a laundry item 40 shown in FIGS. 16 and 17 into a clamping jaw 41 of the spreader clamp 14, a tail 42 of the corner region that is held by the spreader clamp 14, said tail 42 projecting beyond the clamping jaw 41, in the case of a closed clamping jaw 41, thus in the state held by the spreader clamp 14, is movable relative to the spreader clamp 14, in particular to the clamping jaw 41 of the latter. This movement is performed such that the tail 42 is minimized and an outermost corner point 43 of the corner region, in particular of the tail 42, of the laundry item 40 makes its way into the region of a clamping location 44 in the clamping jaw 41 (FIG. 17). On account thereof, the tail 42 (FIG. 16) that projects in relation to the clamping location 44 is eliminated or at least reduced. The laundry item 40 by way of the outermost corner point 43 which corresponds to the geometric corner point of a corner is then held at the clamping location 40 (FIG. 17).

The minimization or elimination described above of the tail 42 of the laundry item 40 in the respective spreader clamp 14 is implemented in that the spreader clamps 14 thereof have a conveying means for moving or repositioning, respectively, the held corner region of the laundry item 40 for the purpose of minimizing the tail 42. In the case of the exemplary embodiment of the invention shown in FIGS. 16 and 17 the conveying means are two mutually communicating rolls 45, 46. The rolls 45, 46 form a roll pair having a linear roll nip 47 lying therebetween in the case of a closed clamping jaw 41 (FIG. 17). Said linear roll nip 47 forms the clamping location 44 of a tail 42, or of an outermost corner 43, respectively, of one of the neighboring corners of the front transverse edge of the laundry item 14 to be tautly stretched.

One of the two rolls 45, 46 of the respective spreader clamp 14, specifically the roll 46, is rotatingly drivable. The other non-driven roll 45 of the roll pair at one end of a pivot axis 48 is pivotable about the latter. Said pivot axis 48 runs so as to be perpendicular to the rotation axis of the freely rotatable roll 45. The pivot axis 48 is assigned to that end side of the rolls 45 that points toward the carriage 15. The roll 45 is pivoted by a suitable linear drive, in the exemplary embodiment shown a pneumatic cylinder 49, or else a pivot drive.

The roll 46 that is capable of being rotated out of position is driven by a rotary drive 50 that is assigned to said roll 46. This here in can be an electric motor, in particular a servomotor, or else a pneumatic or mechanical, respectively, rotary drive 50. The rotating path, or the rotating angle, respectively, of the rotary drive 50 need only be so large that the roll 46 is rotated out of position so far that said roll 46 can eliminate the longest imaginary tail 42 which is formed at the respective spreader clamp 14. Depending on the diameter of the roll 46, a pivot angle which is smaller than a full circular revolution of the roll 46 is sufficient to this end.

The reduction or elimination, respectively, described above of the tails 42 of the corner of the front transverse edge of the laundry item 40 held in the spreader clamps 14 is performed after the acquisition of the corners, specifically after the freely rotatable roll 45 is pivoted toward the rotatingly drivable roll 46 and the roll nip 47 that is closed on account thereof. Moving the tail 42 through the spreader clamps 14 can take place directly after the closing of the spreader clamps 14. It is also conceivable for the rolls 46 of the spreader clamps 14 to be rotated out of position for reducing or eliminating the tails 42 during the spreading procedure of the laundry item 14, thus during the diverging of the spreader clamps 14. However, it must be ensured herein that the elimination of the tails 42 in the spreader clamps 14 is completed before the front transverse periphery of the laundry item 40 is completely or at least almost completely tautly stretched or spread, respectively, so that the sag of the front transverse periphery of the laundry item 40 is not enlarged again on account of the tails 42 being moved through the spreader clamps 14.

The above invention of minimizing or eliminating, respectively, the tails 42 of the corner regions of the laundry item 40 held in the spreader clamp 14 is suitable for all types of input machines having spreader clamps 14, and is thus not limited to the device or input machine, respectively, described above and shown in FIGS. 1 to 15.

LIST OF REFERENCE SIGNS

10 Feeding direction
11 Loading station
12 Spreading installation
13 Rail
14 Spreader clamp
15 Carriage
16 Front end
17 Infeed conveyor
18 Loading conveyor
19 Corner locator
20 Transfer clamp
21 Transfer clamp pair
22 Rail
23 Rail
24 Rail
25 End
26 End
27 Belt conveyor
28 Belt conveyor
29 Depositing region
30 End
31 Roll
32 Roll
33 Roll nip
34 Pendulum arm
35 Channel
36 Detection means
37 Sensor line
38 Detection means
39 Sensor line
40 Laundry item
41 Clamping jaw
42 Tail
43 Outermost corner point
44 Clamping point
45 Roll
46 Roll
47 Roll nip
48 Pivot axis
49 Pneumatic cylinder
50 Rotary drive

What is claimed is:

1. A method for feeding laundry items to a laundry treatment installation, in particular a mangle, wherein a transverse periphery is stretched by a spreading installation (12) having spreader clamps (14) for holding neighboring corner regions of the transverse periphery of the laundry item and the laundry item herein is spread out, and the spread-out laundry item by way of the stretched front transverse periphery is deposited onto an infeed conveyor (17) or a depositing strip, comprising:

prior to the laundry items being deposited onto the infeed conveyor (17) or the depositing strip, moving the corner regions through the spreader clamps (14) to outermost corner points (43) of the corner regions and/or close to the outermost corner points (43).

2. The method as claimed in claim 1, wherein the corner regions of the respective laundry item are moved through the spreader clamps (14) so far until the outermost corner points (43) of the corner regions have reached a clamping region of the spreader clamps (14) or are at least located close to the clamping region, and/or the corner regions during the stretching of the front transverse periphery of the laundry item are moved through the spreader clamps (14), wherein preferably said moving of the corners or corner regions, respectively, of the laundry item through the spreader clamps (14) is terminated before the front transverse periphery of the laundry item has been completely stretched.

3. The method as claimed in claim 2, wherein the clamping region of each of the spreader clamps (14) is formed between two neighboring clamping rollers, in particular rolls (45, 46), of which one clamping roller, or roll (46), respectively, is driven in a targeted controlled manner so as to move, in particular transport, the respective corner region of the laundry item (40) through the spreader clamps (14).

4. The method as claimed in claim 3, wherein for opening and/or closing each of the spreader clamps (14) one of the clamping rollers, in particular rolls (45, 46), preferably a freely rotatable clamping roller, or roll (45), respectively, is pivoted relative to the drivable clamping roller, or roll (46), respectively, assigned to the former.

5. A method for feeding laundry items to a laundry treatment installation, in particular a mangle, wherein a respective laundry item by way of a peripheral portion that lies between two neighboring corners of a transverse periphery is deposited on at least one loading station (11), is transported beyond an end of the loading station (11) until two neighboring corner regions of an opposite transverse edge of the laundry item are configured at the end of the loading station (11) and said corner regions of the laundry item are gripped, comprising:

reducing the transporting speed of the laundry item in the respective loading station (11) prior to the corner regions of the laundry item being gripped.

6. The method as claimed in claim 5, further comprising ascertaining the point in time at which the corner regions of the laundry item, preferably each individual corner region of a rear transverse periphery of the laundry item are released from a loading conveyor (18) at the respective loading station (11).

7. The method as claimed in claim 6, wherein the loading station (11) comprises corner locators (19) for transporting therethrough a lateral longitudinal peripheral region of the laundry items, and wherein the transporting speed of laundry item through the loading station (11), in particular the transporting speed of the corner locators (19) of the loading station (11), is reduced at the point in time of the release of the corner regions of the rear transverse periphery of the laundry item from the loading conveyor (18).

8. A device for feeding laundry items to a laundry treatment installation, in particular a mangle, having an infeed conveyor (17) for transporting spread-out laundry items in the feeding direction to the laundry treatment installation, optionally to a depositing strip that is assigned to the infeed conveyor, and a spreading installation (12) for spreading out and subsequently depositing the laundry item on the infeed conveyor (17), or the depositing strip assigned to the latter, respectively, said spreading installation (12) having spreader clamps (14) that are repositionable transversely to the infeed direction (10), wherein the spreader clamps (14) comprise:

conveying members for moving or repositioning, respectively, the corner regions of the respective laundry item that are held by the spreader clamps (14).

9. The device as claimed in claim 8, wherein, for forming the conveying members, each of the spreader clamps (14) has a pair of rolls (45, 46) for tightly clamping in each case one corner region, or one corner, respectively, of the laundry item, at least one roll (46) of said pair of rolls (45, 46) being rotatingly drivable.

10. The device as claimed in claim 9, wherein the rotatingly drivable roll (46) of each of the spreader clamps (14) is assigned a rotary drive (15), preferably a rotary drive (50) that rotates the roll (46) out of position by an adjustable angular range.

11. The device as claimed in claim 9, wherein one of the two rolls (45, 46), preferably a freely rotatable roll (45), for opening and/or closing a respective one of the spreader clamps (14) is pivotable about a pivot axis (48) that runs transversely to the rotation axis of said roll (45, 46).

12. A device for feeding laundry items to a laundry treatment installation, in particular a mangle, having a plurality of loading stations (11) that are disposed beside one another in a row that runs transversely to the feeding direction (10) of the laundry item to the laundry treatment installation, said laundry treatment installation having in each case one loading conveyor (18) and, when viewed in the feeding direction (10), disposed downstream of said loading conveyor (18), corner locators (19) for neighboring corner regions of a transverse periphery of a laundry item, and each of the corner locators (19) being configured for transporting therethrough a lateral longitudinal peripheral region of the laundry item, comprising:

at least one detection means (36), wherein each of the corner locators (19) is assigned the at least one detection means (36) for a rear transverse periphery or transverse peripheral region and/or rear corners or corner regions of the laundry item, and a deceleration of the transporting speed of the laundry item in the respective one of the corner locators (19) assigned to the at least one detection means (36) is capable of being triggered by a respective one of the at least one detection means (36).

13. The device as claimed in claim 12, wherein each corner locator (19) has a roll pair having at least one individually rotatingly drivable roll (31) for transporting in each case one longitudinal peripheral region of the laundry item through the respective one of the corner locators (19) assigned to the roll (31).

14. The device as claimed in claim 13, wherein each of the corner locators (19) is assigned a dedicated detection means (38), preferably a light-barrier-type detection means (38), a sensor line (39) which for ascertaining an outermost location of a corner of the laundry item that is located at the rear end of the respective longitudinal periphery is disposed so as to be close to a roll nip (33) between the rolls (31, 32) of the roll pair and runs parallel with the roll nip (33) being in particular capable of being generated by the respective one of the at least one detection means (36).

15. The device as claimed in claim 12, wherein the corner locators (19) of each of the loading stations (11) are assigned a transfer clamp pair (21) which preferably lies in a plane parallel with the plane in which spreader clamps (14) of a spreading installation (12) are repositionable, wherein the planes have such a spacing that the spreader clamps (14) are capable of being moved in a collision-free manner past transfer clamps (20) of a transfer clamp pair (21), preferably having a laundry item suspended on the transfer clamps (20) and/or the spreader clamps (14).

* * * * *